US006994064B2

(12) United States Patent
Haas et al.

(10) Patent No.: US 6,994,064 B2
(45) Date of Patent: Feb. 7, 2006

(54) GUIDE RAIL FOR THE VALVE TRAIN OF AN INTERNAL COMBUSTION ENGINE

(75) Inventors: Michael Haas, Weisendorf (DE); Norbert Geyer, Höchstadt (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/863,556

(22) Filed: Jun. 8, 2004

(65) Prior Publication Data

US 2005/0098126 A1 May 12, 2005

Related U.S. Application Data

(63) Continuation of application No. PCT/EP02/12868, filed on Nov. 16, 2002.

(30) Foreign Application Priority Data

Dec. 21, 2001 (DE) ..... 101 63 411

(51) Int. Cl.
*F01L 1/14* (2006.01)

(52) U.S. Cl. ..... 123/90.5; 123/90.48; 123/90.51

(58) Field of Classification Search ..... 123/90.5, 123/90.48, 90.51, 90.52, 90.67
See application file for complete search history.

(56) References Cited

U.S. PATENT DOCUMENTS

| | | | | |
|---|---|---|---|---|
| 3,108,580 | A | 10/1963 | Crane, Jr. | |
| 4,207,775 | A | 6/1980 | Lintott | |
| 4,448,155 | A | 5/1984 | Hillebrand et al. | |
| 4,704,995 | A | 11/1987 | Soeters, Jr. | |
| 5,088,455 | A | 2/1992 | Moretz | |
| 5,263,386 | A * | 11/1993 | Campbell et al. | 74/569 |
| 5,307,769 | A | 5/1994 | Meagher et al. | |
| 6,405,699 | B1 | 6/2002 | Church | |

FOREIGN PATENT DOCUMENTS

DE 197 12 610 A1 11/1997

* cited by examiner

*Primary Examiner*—Thomas Denion
*Assistant Examiner*—Zelalem Eshete
(74) *Attorney, Agent, or Firm*—Henry M. Feiereisen

(57) ABSTRACT

In a guide rail for the valve train of an internal combustion engine, having receiving spaces disposed in an elongate body in spaced-apart relationship behind one another and accommodating valve lifters, flats are formed upon the outer surface area of each valve lifter to prevent the lifter from rotating about its central longitudinal axis. These flats are supported by flats of the guide rail which are located within the pertaining receiving space. An inlet bore is assigned to each receiving space of the elongate body for insertion of the valve lifter with an attached trumpet-like end in direction of its longitudinal axis. Subsequently the valve lifter is shifted in axis-parallel relationship to the flats of the guide rail, which act as rotation-inhibiting surfaces, and then is slightly displaced again in axial direction.

13 Claims, 1 Drawing Sheet

GUIDE RAIL FOR THE VALVE TRAIN OF AN INTERNAL COMBUSTION ENGINE

CROSS-REFERENCES TO RELATED APPLICATIONS

This application is a continuation of prior filed copending PCT International application no. PCT/EP02/12868, filed Nov. 16, 2002, which designated the United States and on which priority is claimed under 35 U.S.C. §120, the disclosure of which is hereby incorporated by reference, and which copending PCT International application no. PCT/EP02/12868, filed Nov. 16, 2002 claims the priority of German Patent Application, Serial No. 101 63 411.0, filed Dec. 21, 2001, pursuant to 35 U.S.C. 119(a)–(d), the disclosure of which is incorporated herein by reference.

BACKGROUND OF THE INVENTION

The present invention relates, in general, to a guide rail for the valve train of an internal combustion engine.

Guide rails are used in internal combustion engines for preventing rotations of valve lifters that are configured as roller lifters. In addition, guide rails serve as installation aid and may be used in particular for the roller lifters of a pushrod valve train. German patent publication DE 197 12 610 A1 describes a guide rail for an internal combustion engine of a type having receiving sockets spaced along the length thereof for accommodating valve lifters. The valve lifters, typically roller valve lifters, are in engagement with cam lobes of a camshaft. As the lifters must not rotate about its longitudinal axis, because the roller on the lifter must remain in the same plane as the cam lobe, the lifters are suitably aligned in the cylinder block of the internal combustion engine by particular retainers and restrained against rotation.

Roller lifters for certain motors with V-shaped arrangement of the cylinders are widened in a trumpet-shaped manner at the contact area of the pushrod, because the pushrod would otherwise contact the associated springy support sheet as a consequence of its tilt angle in relation to the longitudinal lifter axis.

It would therefore be desirable and advantageous to provide an improved guide rail to prevent such a contact and to construct it to allow valve lifters, which are widened in trumpet-shaped manner, to be installed and retained in a simple manner while yet being reliable in operation.

SUMMARY OF THE INVENTION

According to one aspect of the present invention, a guide rail for the valve train of an internal combustion engine, comprising an elongate body having a plurality of receiving spaces disposed in spaced-apart relationship behind one another for accommodating valve lifters formed with a trumpet-like end, with the receiving spaces having flats for support of complementary flats on an outer surface area of the valve lifters to prevent the valve lifters from rotating about their longitudinal axis, wherein each of the receiving spaces has an inlet bore sized to allow insertion of the valve lifter and subsequent shift of the valve lifter in axis-parallel relationship to the flats of the receiving space, and slight displacement thereof in axial direction.

According to another feature of the present invention, each of the receiving spaces may have a recess for arrangement and retention of the trumpet-like end of the valve lifter. Suitably, the recess is configured in the shape of a circular segment.

According to another feature of the present invention, the elongate body may be made of fiber-reinforced plastic or may be realized as a punched metal part.

According to another aspect of the present invention, a guide rail for the valve train of an internal combustion engine, comprising an elongate body having a plurality of receiving spaces disposed in spaced-apart relationship behind one another for accommodating valve lifters formed with a trumpet-like end, with the receiving spaces having flats for support of complementary flats on an outer surface area of the valve lifters to prevent the valve lifters from rotating about their longitudinal axis, wherein the elongate body is divided along a symmetry plane which extends through the receiving spaces to thereby define two rail members detachable from one another.

According to another feature of the present invention, the elongate body has opposite ends, with locking devices being provided for securing the rail members to one another at their opposite ends. Suitably, the locking devices are configured as clip connectors. Also, a guide rail of this type may be made of fiber-reinforced plastic, or may be realized as a punched metal part.

According to another feature of the present invention, each of the receiving spaces may be configured as stepped bore having an upper bore part and a lower bore part of an inside diameter which is smaller than an inside diameter of the upper bore part to thereby define a ledge for support of the trumpet-like end of the valve lifter. Suitably, the lower bore part includes the flats in the receiving space.

According to still another aspect of the present invention, a method of mounting a valve lifter to a guide rail includes the steps of inserting a valve lifter with attached trumpet-like end through an inlet bore of the guide rail, shifting the valve lifter sideways from the inlet bore to an adjacent receiving space until a flat surface of the receiving space is in alignment with a complementary flat surface of the valve lifter, and slightly displacing the valve lifter in axial direction downwards to establish a firm seat of the valve lifter in a recess of the receiving space.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
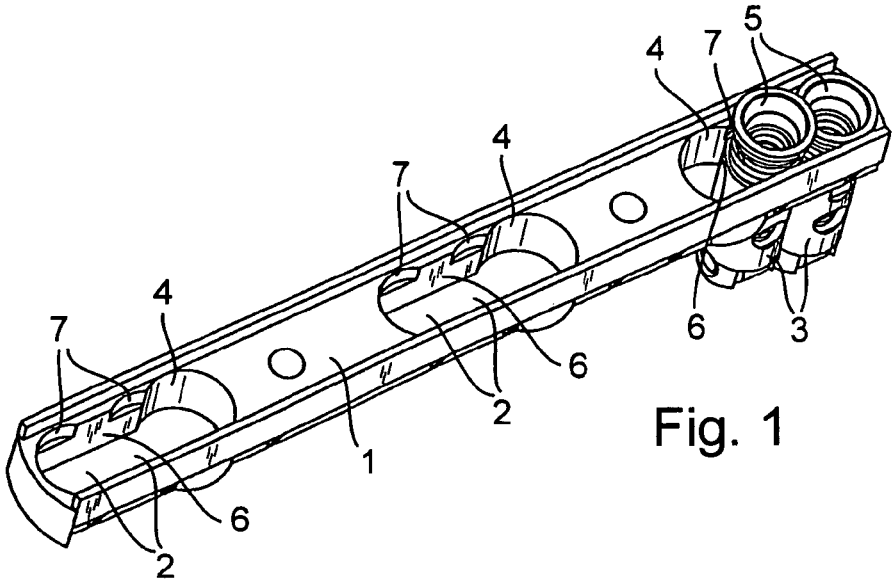
FIG. 1 a perspective illustration of a first embodiment of a guide rail according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective view of a first embodiment of a guide rail 1 according to the present invention. The guide rail 1 has an elongate body formed with several receiving spaces 2 in spaced-apart relationship behind one another for receiving valve lifters 3. Two receiving spaces 2 are respectively disposed in pairs and connected with an inlet bore 4 through which a valve lifter 3, provided with a trumpet-like end 5, can be passed through. The valve lifter 3 is provided on its outer surface area with flats which cooperate with flats 6 of the guide rail 1, disposed within the receiving spaces 2, when the valve lifter 2 is inserted in the inlet bore 4 and shifted from there in one of both pairs of receiving spaces 2. This movement is accompanied by a parallel displacement of the longitudinal axis of the valve lifter 3. The flats of the valve lifter 3 and the flats 6 of the guide rail 1 support one another so that a rotation of the valve lifter 3, held by the guide rail 1, about its longitudinal axis is not possible.

After being displaced from the inlet bore 4 to the receiving space 2, the valve lifter 3 is pulled downwards in piston direction, i.e. in direction of its longitudinal axis, thereby moving the trumpet-like end 5 of the valve lifter 3 in circular segment shaped recesses 7 of the guide rail 1, which are associated to each receiving space 2. In this way, a movement of the valve lifter 3 back into the inlet bore 4 is prevented. Once the guide rail 1 is equipped with all the valve lifters 3 in this manner, it can be mounted to the internal combustion engine.

Figure 2:
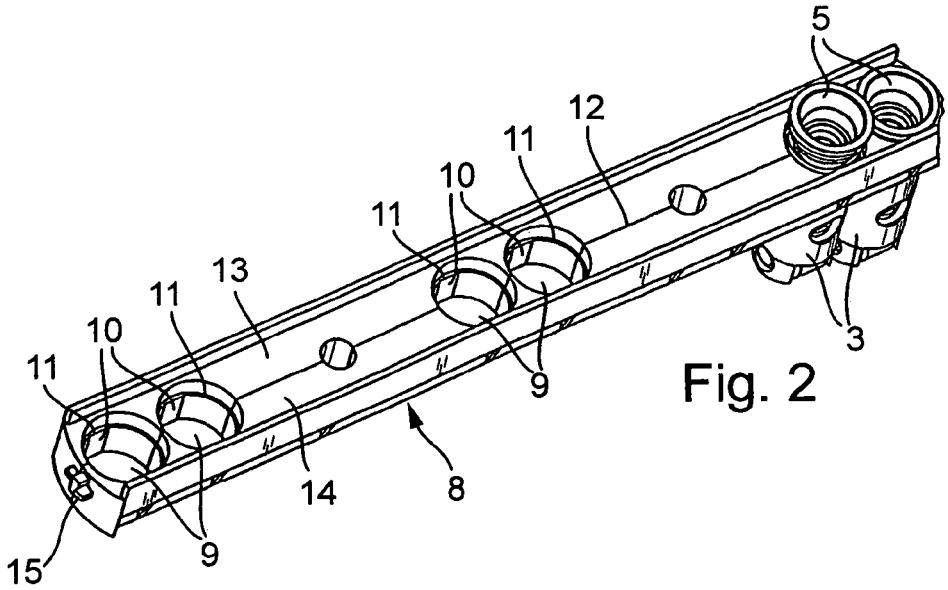
FIG. 2 a perspective illustration of a second embodiment of a guide rail according to the present invention.

Turning now to FIG. 2, there is shown a perspective view of a second embodiment of a guide rail according to the present invention, generally designated by reference numeral 8. The guide rail 8 is provided with several pairs of receiving spaces 9 in spaced-apart relationship behind one another for accommodating the valve lifters 3. Each receiving space 9 is configured as stepped bore defining an upper bore part and a lower bore part which has a smaller inside diameter than the inside diameter of the upper bore part, to thereby define a ledge or ring-shaped contact surface 11 which separates the lower bore part from the upper bore part of the receiving space 9. The lower bore part in the guide rail 8 is configured with flats 10 for preventing rotation of the installed valve lifter 3 about its longitudinal axis. The trumpet-like end 5 of the valve lifter 3 is able to axially support on the ledge 11.

The guide rail 8 has an elongate body which is split along a symmetry plane 12, which extends through all the receiving spaces 9, thereby defining two rail members 13 and 14 which are laid during installation about the flats of the valve lifter 3 to be installed, which flats act as rotation-inhibiting surfaces, and which are assembled for formation of the guide rail 8. Thereafter, the rail members 13, 14 are secured to one another by locking devices 15 which are arranged at the longitudinal ends of the guide rails 8 and configured as clip connectors. In this way, the valve lifters 3 can neither fall out or be removed downwards or upwards.

Figure 3:
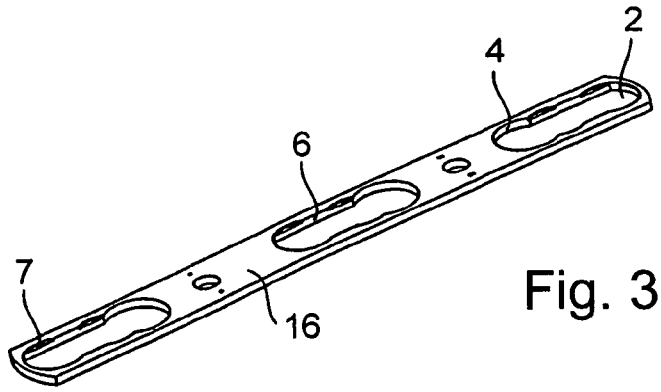
FIG. 3 a perspective illustration of a third embodiment of a guide rail according to the present invention which has a base shape in correspondence to the guide rail of FIG. 1 but is thinner in size.

Turning now to FIG. 3, there is shown a perspective view of a third embodiment of a guide rail according to the present invention, generally designated by reference numeral 16. The guide rail 16 is implemented a punched metal part and may be made from a band material in a simple manner. It is provided in analogy to the guide rail 1 of FIG. 1 with the inlet bores 4, the receiving spaces 2, the flats 6 and the recesses 7. The use of band material allows reduction in structural height of the guide rail 16 to about 2 to 3 mm.

Depending on the cam lift and the height of the rotation-inhibiting surfaces of the internal combustion engine, the thickness of the guide rail may vary. Also the used material is determinative for the configuration and height of the guide rail. The use of fiber-reinforced plastic results, for example, in a rail construction as illustrated in FIGS. 1 and 2.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A guide rail for the valve train of an internal combustion engine, comprising an elongate body having a plurality of receiving spaces disposed in spaced-apart relationship behind one another for accommodating valve lifters formed with a trumpet-like end, said receiving spaces having flats for support of complementary flats on an outer surface area of the valve lifters to prevent the valve lifters from rotating about their longitudinal axis, wherein each of the receiving spaces has an inlet bore sized to allow insertion and rotation of the valve lifter and subsequent shift of the valve lifter in axis-parallel relationship to the flats of the receiving space to prevent the valve lifters from rotating, and to allow slight displacement thereof in axial direction.

2. The guide rail of claim 1, wherein each of the receiving spaces has a recess for arrangement and retention of the trumpet-like end of the valve lifter.

3. The guide rail of claim 2, wherein the recess is configured in the shape of a circular segment.

4. The guide rail of claim 1, wherein the elongate body is made of fiber-reinforced plastic.

5. The guide rail of claim 1, wherein the elongate body is a punched metal part.

6. A guide rail for the valve train of an internal combustion engine, comprising an elongate body having a plurality of receiving spaces disposed in spaced-apart relationship behind one another for accommodating valve lifters formed with a trumpet-like end, said receiving spaces having flats for support of complementary flats on an outer surface area of the valve lifters to prevent the valve lifters from rotating about their longitudinal axis, wherein the elongate body is divided along a symmetry plane which extends through the receiving spaces to thereby define two rail members detachable from one another.

7. The guide rail of claim 6, wherein the elongate body has opposite ends, and further comprising locking devices for securing the rail members to one another at their opposite ends.

8. The guide rail of claim 7, wherein the locking devices are configured as clip connectors.

9. The guide rail of claim 6, wherein each of the receiving spaces is configured as stepped bore having an upper bore part and a lower bore part of an inside diameter which is smaller than an inside diameter of the upper bore part to thereby define a ledge for support of the trumpet-like end of the valve lifter.

10. The guide rail of claim 9, wherein the lower bore part includes the flats in the receiving space.

11. The guide rail of claim 6, wherein the elongate body is made of fiber-reinforced plastic.

12. The guide rail of claim 6, wherein the elongate body is a punched metal part.

13. A method of mounting a valve lifter to a guide rail, comprising the steps of:

inserting a valve lifter with attached trumpet-like end through an inlet bore of the guide rail;

aligning a flat surface of the valve lifter with a flat surface of a receiving space adjacent to the inlet bore;

shifting the valve lifter sideways from the inlet bore to the receiving space until the flat surface of the receiving space and the flat surface of the valve lifter extend coextensively; and slightly moving the valve lifter in axial direction downwards to establish a firm seat of the valve lifter in a recess of the receiving space.

* * * * *